US008166615B2

(12) United States Patent
Coldiron

(10) Patent No.: US 8,166,615 B2
(45) Date of Patent: May 1, 2012

(54) APPAREL ACCESSORY CLAMP

(75) Inventor: Audra Coldiron, Willards, MD (US)

(73) Assignee: The Hip Klub, LLC, Pittsville, MD (US)

( * ) Notice: Subject to any disclaimer, the term of this patent is extended or adjusted under 35 U.S.C. 154(b) by 377 days.

(21) Appl. No.: 12/499,282

(22) Filed: Jul. 8, 2009

(65) Prior Publication Data

US 2010/0031476 A1 Feb. 11, 2010

Related U.S. Application Data

(60) Provisional application No. 61/102,446, filed on Oct. 3, 2008, provisional application No. 61/087,703, filed on Aug. 10, 2008.

(51) Int. Cl.
*A44B 21/00* (2006.01)
*A45F 5/02* (2006.01)

(52) U.S. Cl. ..... 24/3.12; 24/3.11; 24/328; 24/348

(58) Field of Classification Search ..... None
See application file for complete search history.

(56) References Cited

U.S. PATENT DOCUMENTS 6,085,393 A * 7/2000 Tsui et al. ..... 24/3.12
2004/0045133 A1* 3/2004 Buettell ..... 24/3.12

* cited by examiner

*Primary Examiner* — Jack W. Lavinder
(74) *Attorney, Agent, or Firm* — Berenato & White, LLC

(57) ABSTRACT

A wearable, item attaching, apparel clamp is disclosed. The clamp broadly includes a clamping jaw and an underlying opposed clamping jaw capable of permanently or temporarily attaching a personal item either directly or indirectly to whatever substrate or fabric edge the clamp is attached. The clamping jaw attaches to the underlying jaw via a hinge element which includes a fulcrum. An article connecting element attaches to the clamping jaw and extends toward or beyond the securing portion of the clamping jaws. The connecting element contains a resilient opening large enough to attach a second item directly or indirectly. Such other item may include a key chain, chain link, receptacle, or the like, thus enabling the item to hang below the bottom of the clamp. The underlying clamping jaw(s) distribute the weight of the attached item relative to the clamp preventing the flexible substrate to which the clamp can fasten from excessive bending. The clamp can also be used to attach the personal item to another accessory such as a purse, beach bag, backpack, etc. In addition it is conceivable that the invention could be used to attach items to upholstery, curtains, blankets, towels, or even to hang items from a clothes line, cooking pots, etc.

4 Claims, 7 Drawing Sheets

APPAREL ACCESSORY CLAMP

This application claims the benefit of prior filed U.S. Provisional 61/102,446, filed Oct. 3, 2008; and 61/087,703, filed Aug. 10, 2008.

BACKGROUND OF THE INVENTION

1. Field of Invention

The present invention relates to jewelry and clothing accessories, and more particularly, multi-use wearable accessories for supporting items such as, but not limited to, keys or a receptacle for personal items such as keys, money, ID, credit cards, or other personal effects.

2. Discussion of the Prior Art

Desire for a hands free device and method for conveniently, securely, and attractively carrying one or more items on one's person, for travel, entertainment, sports and fitness, or general daily use, has resulted in numerous inventions intended to address this problem. The attachment mechanisms of these inventions include various clips, clamps, straps, belts, Velcro™, clasps, and chains, etc. While the devices referred to provide a limited degree of security, convenience, and/or aesthetic appeal for carrying valuables, they each possess drawbacks which render them not entirely satisfactory.

Some of these items have inconvenient fastening methods which require a specific article of clothing, a pocket, in order to attach to one's person. Others can slip off or be released easily with or without the knowledge of the wearer; creating a security concern. Some are poorly designed to where the clamp can be released by lifting the attached item also threatening security. Some fasteners are similar in appearance but when connected to a personal item may cause the underlying supporting material to which it is clamped to bend over exposing the underside. This not only reduces the convenience and aesthetic appeal but also the safety due to the increased chance the clamp could slip off the material.

Several other inventions have attempted to overcome some of the disadvantages of the previously mentioned disclosures for attachment methods for carrying valuables. Although these attempt to address some of the previously mentioned disadvantages, and are generally closer in category to the current invention, all the attachment methods heretofore known suffer from a variety of disadvantages such as the following:

- Threatened security of attached articles (i.e., inadvertent detachment).
- Potential damage to supporting garment or fabric when in use.
- Cause user discomfort.
- Poorly integrated features.
- Limited accessibility.
- Lacks interchangeability.
- Lacks versatility for range of use.
- Inconvenient and difficult to use.
- Inefficient or prohibitive to manufacture.
- Unreliable in operation and subject to failure.
- Incorporate odd or complex mechanisms.

A need has arisen, therefore, for a comfortable, attractive, convenient, simple, reliable and cost effective method for attaching valuables to your person or personal item for use in a wide variety of situations and activities. The fastening device of the present invention meets this need and overcomes the aforementioned disadvantages.

SUMMARY OF THE INVENTION

It is an object of the present invention to overcome the shortcomings of the other known solutions.

It is also an object to provide a single device permitting the user to wear, retain, and/or clamp a wide variety of personal effects on his or her person, as needs dictate, keeping both hands and arms free.

The object of this invention also is to clamp a personal item to the wearer no matter what garment he or she might be wearing.

Another important object of this invention is to prevent the fabric or flexible substrate to which the clamp can fasten from bending over due to the weight of the attachment exposing the underside of the said material.

The invention is a wearable connecting clamp including the following:

A clamping jaw that contains a fulcrum that sits opposite a pair of opposed clamping elements. This jaw element should be composed of a sturdy material such as but not limited to metal, plastic, wood, etc. with the preference being a light sheet metal. The respective clamping elements can be one or two pieces connected proximate the fulcrum by, for example, molding, welding, tongue and groove, bolts, screws, hinges, springs, etc. and may be any shape that does not interfere with their clamping function.

A bottom connecting device that attaches to the outside or inside of the clamping jaw element by, for example, bolts, screws, molding, glue, hook, magnetic attraction, etc., and hangs toward the free meeting ends of the clamping jaw distal from the fulcrum. The bottom connecting device featuring a method of attachment such as velcro, a loop, hole, snap, etc. capable of permanently or temporarily attaching a personal item directly or indirectly. This device may be composed of any flexible and/or sturdy material such as metal, plastic, leather, fabric, rope, etc., with the preference being light sheet metal.

When the movable jaw is opened, a flexible substrate such as the waistband of pants can be inserted between the respective clamping elements, i.e., one opposed clamping element on one side of the material and the other on the opposite side. When the movable jaw is closed, the fulcrum cooperatively urges a wedging element associated with the moveable jaw against the clamping elements applying adequate pressure to the inserted material resulting in a sturdy hold. The bottom connecting device attached to the clamping jaw distributes the weight of the attached item relative to the clamp, thus preventing the flexible substrate (i.e., waistband, etc.) to which the clamp can fasten from bending over and exposing the underside of the material.

Further, this clamping device can also have one or more of the following:

An additional securing device located between the opposed clamping elements. The securing device(s) can be made of any substantially strong or flexible material such as metal, wood, plastic rubber, silicone, or the like and can be inside the clamping elements on one or both sides to meet and interlock with an opposed securing device when the clamp is closed. Such additional securing devices would be present to further assist in securing the clamp to an underlying substrate.

A top lid and/or bottom lid attached to the outside of the jaw element for function or decoration. Either lid could be detachable and may host interchangeable decorative and/or functional items. The lids may be any shape or material as long as it does not interfere with the function of the clamp. These lids may be made of a solid and/or flexible material and can be attached in by means is but not limited to glue, screws, molding, bolts, snaps, hooks, magnetic attraction, etc.

Multiple connecting devices may also be supplied for attaching a plurality of articles to the clamp device. Removable decorations made of any shape or material may also connected in any suitable manner, i.e., glue, snap, rivet, etc. Logos or other artwork can be on the lids movable jaw element either by but not limited to stamping, molding, or painting.

Though the device herein is intended for attaching personal wallet sized items to one's clothing, it can also be used to attach personal item(s) to another accessory such as a purse, beach bag, backpack, etc. In addition it is conceivable that the invention could be used to attach items to upholstery, curtains, blankets, towels, or even to hang items from a clothes line, metal pots, etc.

DESCRIPTION PREFERRED EMBODIMENT

Figure 1A:
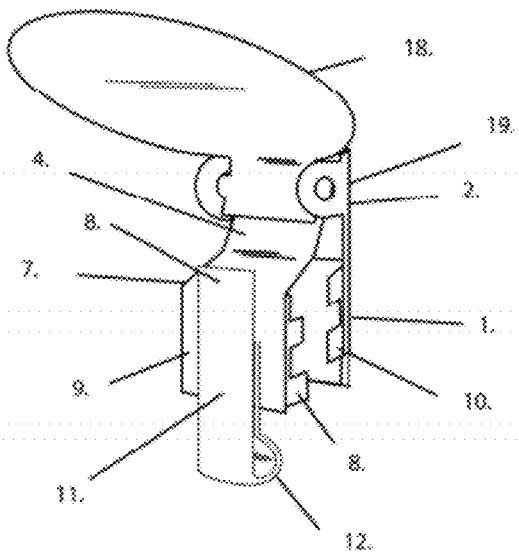
FIG. 1*a* shows the clamp herein in an open position.
Figure 2A:
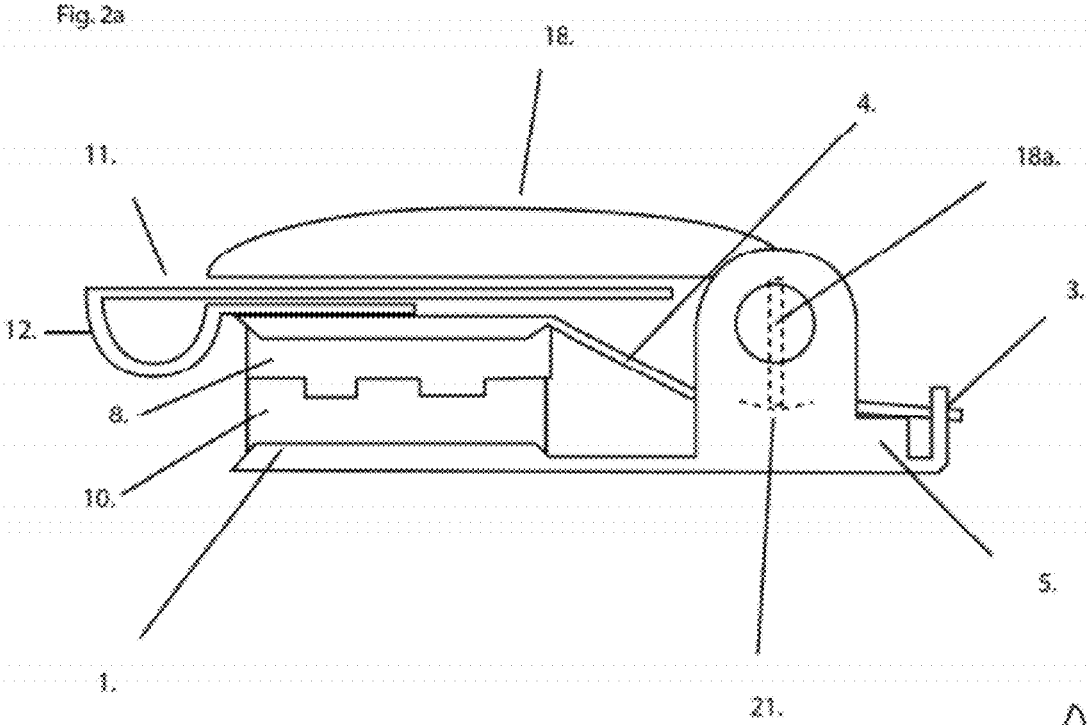
FIG. 2*a* is a side view in the closed position.
Figure 2B:
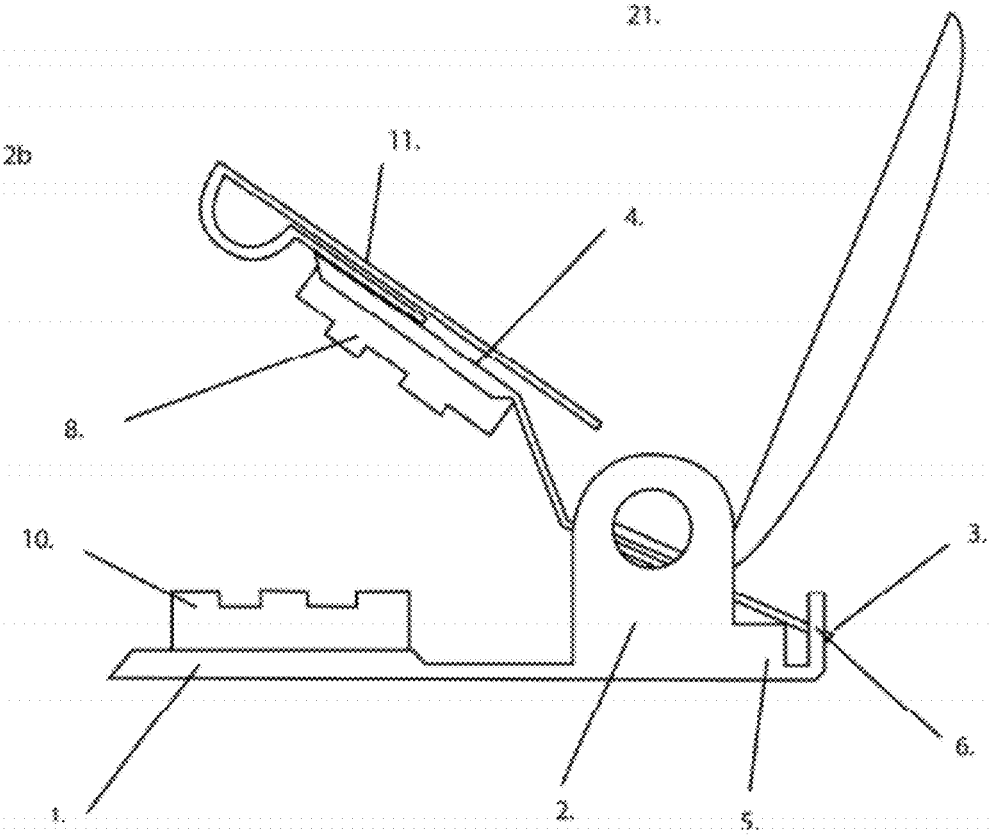
FIG. 2*b* is a side view if the open position.

In the preferred embodiment of this invention, with reference to FIGS. 1*a*, 2*a*, 2*b*, the base (1) contains two tabs (2) on opposed sides of the base that face each other in an approximately parallel arrangement. Past the tabs at the top of the base (1), the base (1) includes a further upwardly bent portion (3) including a passageway therein, including an upper edge (6), for accepting an end segment of the movable jaw (4). The end segment of (4) is inserted into the passageway contained in (3) and over spring element (5) (shown here as a further tab bent from each side of base (1)) such that the spring (5) biases against moveable jaw (4) holding the respective base (1) and jaw (4) in an open position when the end segment of jaw (4) is held against upper edge (6). The spring element (5) can be a separate element held in place on (1) by glue, molding, or other attaching method. The base (1) can alternatively curl around the end segment of the movable jaw (4) instead of the shown insertion of a tab from (4) into a slot contained in upturned (3).

The movable jaw (4) extends toward the bottom of the base jaw, and is sloped away from the base (1) at an angle equal to approximately 30 degrees and, thereafter bends toward the base jaw (1). Gripping teeth with serrated edges (8), preferably made of plastic or silicone, attach to the underside of the second half of the bend (9) and meet up with matching but opposing serrated edges (10) on the base jaw. These gripping teeth meet so as to securely hold fabric or flexible substrate when the clamp is closed.

On the opposite side of the movable jaw (4) from the top teeth (8) is the location for the bottom connecting device (11). This element (11) can be attached by the same fastener that also holds the top gripping teeth (8) to the movable jaw. This bottom connecting element (11) is preferably composed of a flexible, resilient, strong, flat piece of metal folded over on itself and creating a loop (12) at the bottom end thereof. This loop extends past the bottom end of the clamp (13) located at the end of (1) and (4) opposite the fulcrum. The loop on element (11) ultimately holds the personal attachment (24). The two ends of element (11) meet unevenly (14). The short end (15) is attached to the movable jaw either by glue, bolt, screws, etc. The longer piece (16) extends upward past the bend in the movable jaw (4) enabling the user to easily insert or remove an intermediate connecting device or the attached item itself (17).

The top lid (18) in this embodiment includes a functional L-shaped lever or wedging element with laterally positioned tab inserts (19) that extend from the shorter portion of the L and align with and co-act in the singular holes (20) of the tabs (2) of the base jaw. When this L-shaped lever is in a closed position it forces the jaw closed by placing pressure on the movable jaw (4) on the side opposite the spring (5). This action is depicted in partial section in FIG. 2*a* as (21), wherein element 18*a*, co-acting with fulcrum (6) and spring (5) securely clamps elements (8) and (10) onto a flexible substrate (27).

When the lid (18) opens the jaw (4) releases and the clamp can be easily removed from the substrate. The base, movable jaw, and L-shaped lever work together in a manner similar to clamps used with suspenders (e.g., for attachment to the waist band of the pants). Preferably the clamp would be worn on an article of clothing such as the waistband of pants (22) and could be turned either direction with the top lid toward the body (23) or away from the body (22), thus enabling the attached item to be between the body and clothing or on the outside of the clothing.

In alternate versions, the bottom extending clip may be removed, and the bottom connecting device (11) may be permanently attached on the outside of the base jaw. For example, by a rivet type fastener that doesn't allow for the attachment to be removed. Decorative elements may also be applied either permanently or temporarily.

Figure 1B:
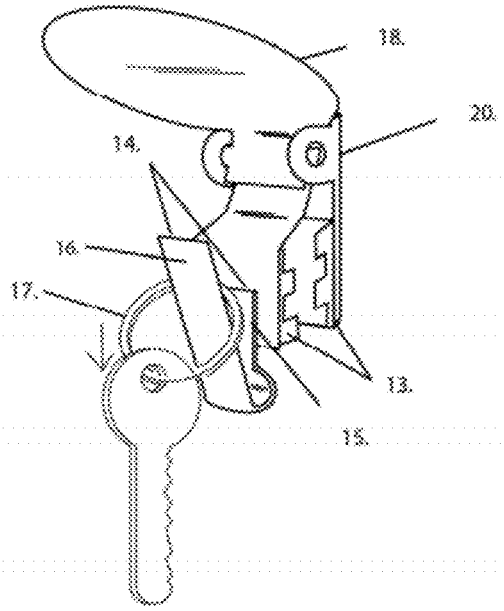
FIG. 1*b* shows the clamp in an open position with an attachment (keyring) sliding off/on the bottom connecting device.

FIG. 1*a*. demonstrates the clamp embodiment with the top lid (18) in an open position which thereby releases the movable jaw (4) from the base jaw (1). When in this open position, a personal item containing an adequately sized opening such as but not limited to a key ring (17), or large grommet, can be attached to the bottom connecting device (11) as shown in FIG. 1*b*. This can be accomplished by inserting the opening of the personal item or another item which connects to a personal item at the top of the connecting device (16) beginning slightly above the bend (7) in the movable jaw (4). With adequate pressure the bottom connecting device (11) bends resiliently backwards away from the clamp giving room for the attachment opening on the personal item to slide downward toward the bottom loop (12). To remove the personal item, a user merely reverses the previously described action.

Figure 1C:
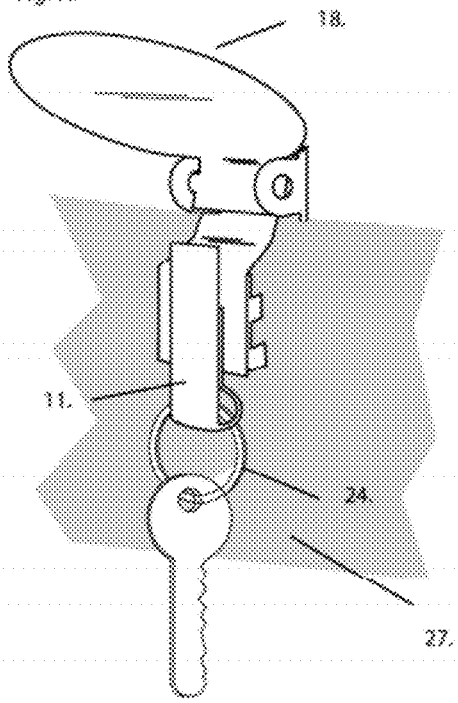
FIG. 1*c* shows the clamp in an open position with keyring attachment in position for clamping to an underlying substrate.
Figure 1D:
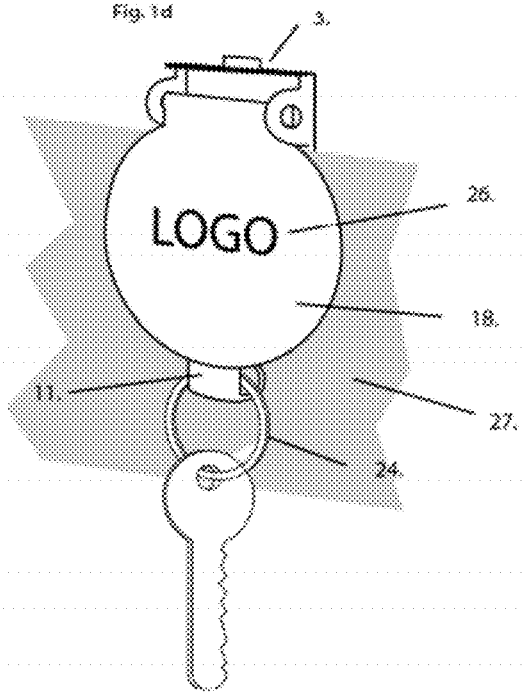
FIG. 1*d* shows the clamp in a closed position with keyring attachment.

FIG. 1*c* shows the attached personal item (17) in its final position with a flexible substrate (27) inserted between the movable jaw and the base jaw. When the hinged top lid closes (18) as in FIG. 1*d* its L-shape wedge portion (18*a* of FIG. 2) provides force against the movable jaw (4) on the opposite side of the spring (5) enabling device to wedge into a closed, clamped, position. This secures the jaws together toward each other and securely holds the flexible substrate (#27) in place.

FIG. 2 demonstrates the side view of the invention and clearly shows the L-shape wedge element (18*a*) of the top lid (18). When the lid is in the closed position of FIG. 2*a*, the L-shape applies force (depicted as 21) to the movable jaw on the side of the spring (5). This enables the jaws to securely shut with the top (8) and bottom teeth (10) interlaced thereby further securing the clamping action. The bottom connecting device (11) attaches to the outside of the movable jaw underneath the top lid and advantageously extends its loop portion (12) beyond the top lid (18) when the top lid is in the closed position. Again, as previously noted, when the lid (18) is in the opened position as demonstrated by FIG. 2*b*, the spring action is released and the movable jaw (4) and the base jaw (1) are forced apart causing the clamp to open.

Figure 3A:
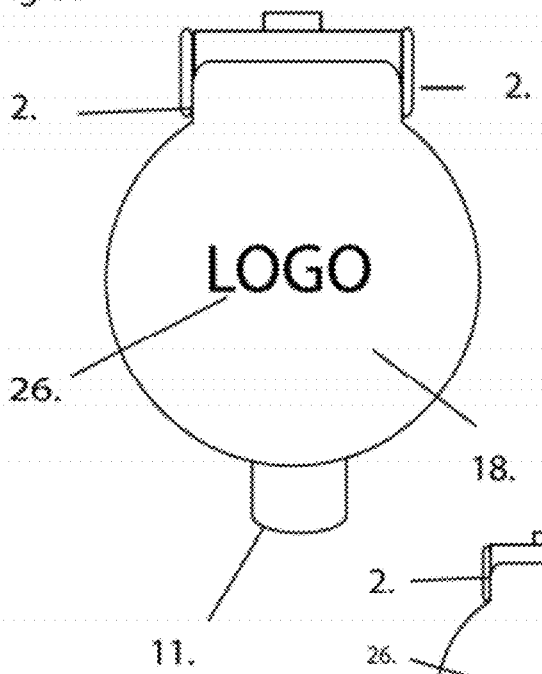
FIG. 3*a* is a front view in the closed position.
Figure 3B:
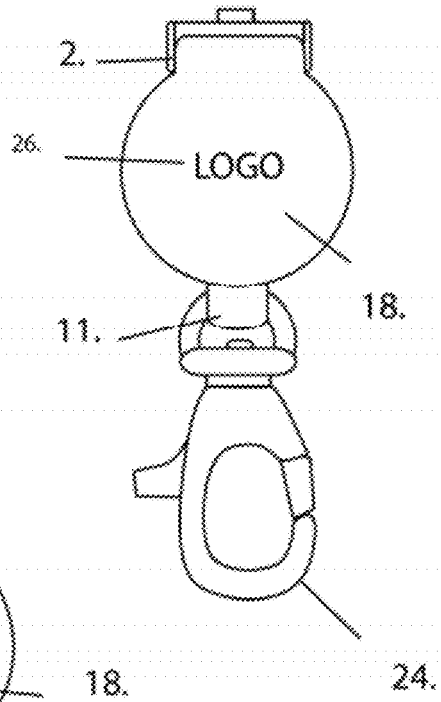
FIG. 3*b* is a closed position with a snap bolt attachment.
Figure 3C:
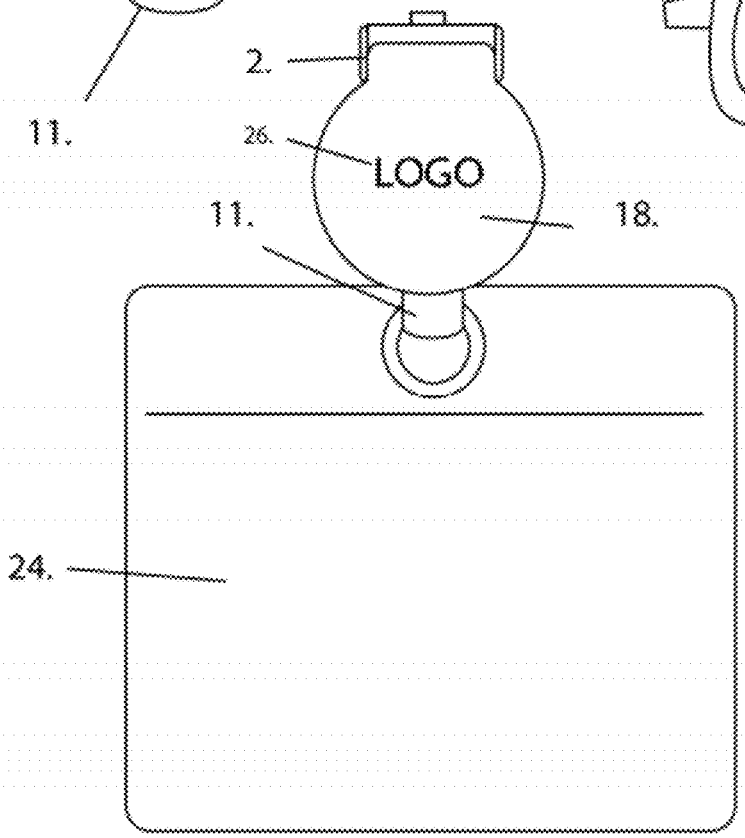
FIG. 3*c* is a closed position with a pocket attachment.

FIG. 3 demonstrates the view of the invention from the front. A logo or other artwork (26) can be displayed on the top lid (18). A variety of personal items (24) can be attached from the bottom connecting device (11) and associated loop (12) whether it is directly connected, such as demonstrated by FIG. 1*c*, or is indirectly connected as demonstrated by FIG. 3*b*. In the indirect connection, a personal item may be held secured by connecting a snap bolt (24) which can then connect to a personal item such as keys or a receptacle.

Figure 4:
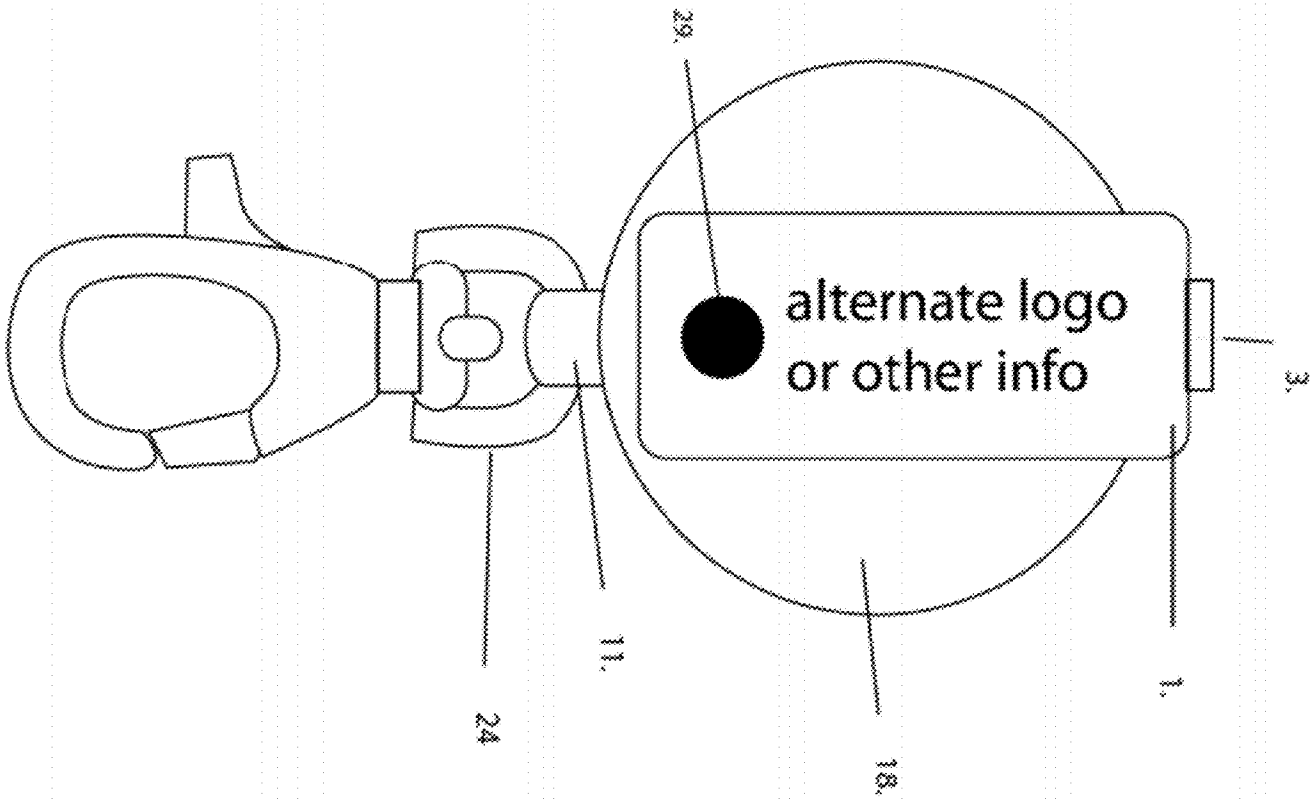
FIG. 4 is a rearward view of the combination shown in FIG. 3*b*.

FIG. 4 demonstrates the invention from the back. Here on the back of the base jaw (1) an alternate logo or other instructional information can be placed. The attachment for the bottom gripping teeth can be seen here (29) as well.

Figure 5A:
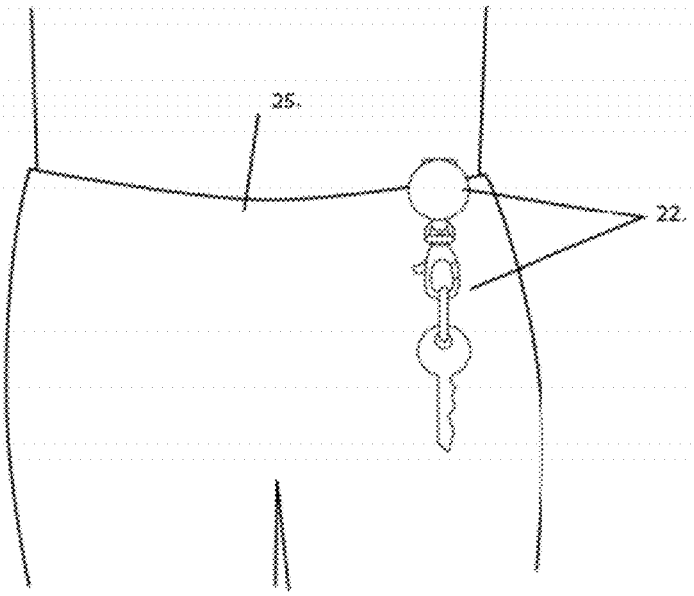
FIG. 5*a* shows the device of FIG. 3*b* in use.
Figure 5B:
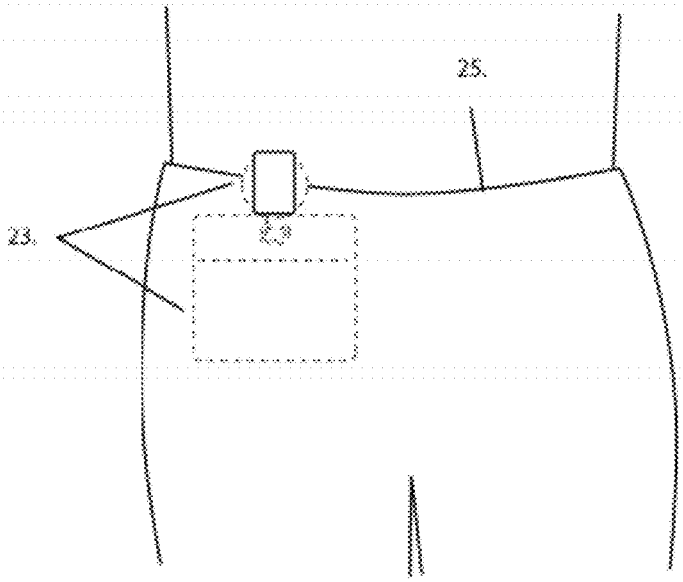
FIG. 5*b* shows the combination of 3*c* in use.
Figure 6A:
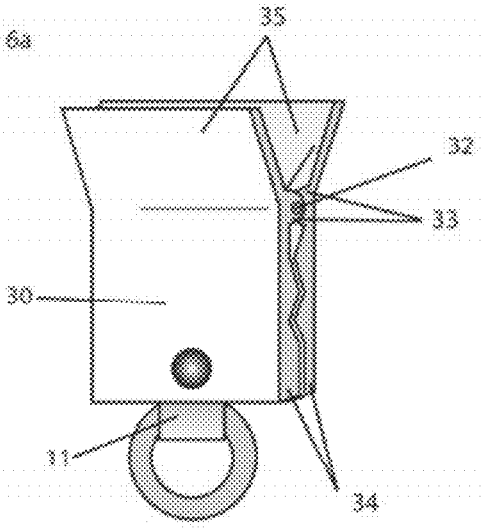
FIG. 6*a* shows a front side of a 1$^{st}$ alternative embodiment of the clamp herein.
Figure 6B:
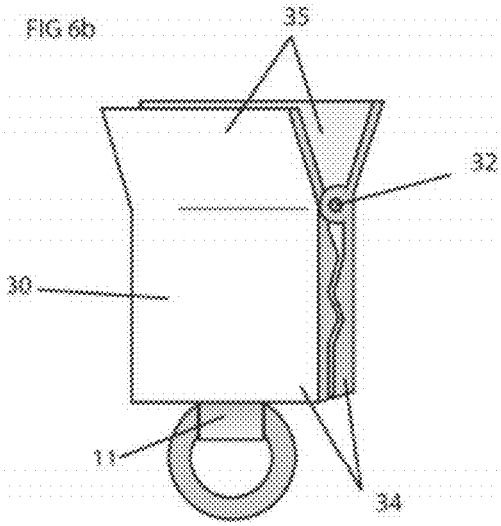
FIG. 6*b* shows a rearward view of the clamp shown in FIG. 6*a*.
Figure 6C:
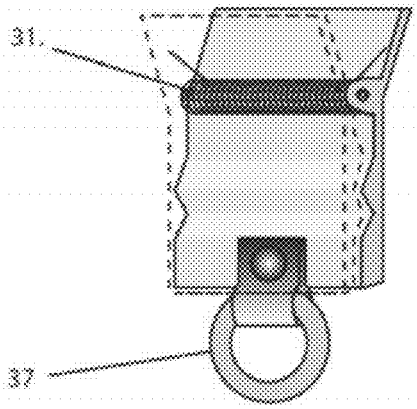
FIG. 6*c* shows a partial view through of the clamp of FIG. 6*a* showing the attaching element attached to one of the jaw elements.
Figure 7:
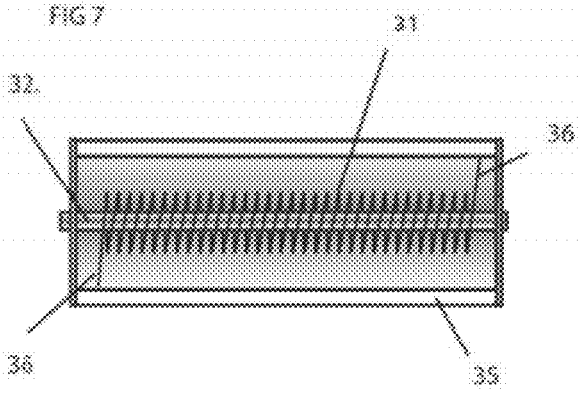
FIG. 7 shows a top view of the FIG. 6*a* clamp showing the spring biasing element.
Figure 8A:
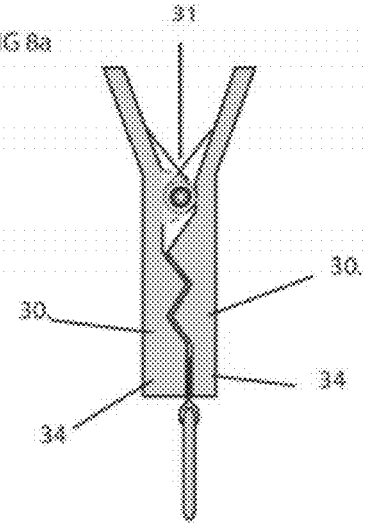
FIG. 8*a* shows a side view of the clamp shown in FIG. 6*a*.
Figure 8B:
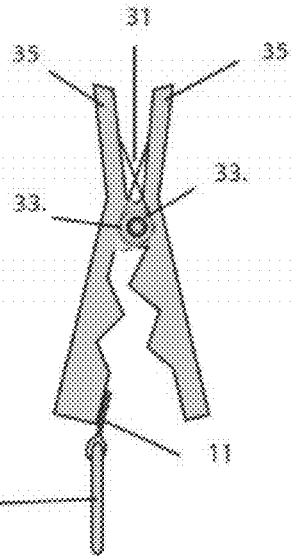
FIG. 8*b* shows a side view of the FIG. 6*a* clamp in the open position.

FIG. 5 demonstrates the intended use for this invention. FIG. 5*a* shows the invention being fastened to the waistband of a pair of pants (25) with the bottom connecting device (11) facing the outwardly (22). Here the personal item is connected indirectly through a snap bolt (24). FIG. 5*a* shows the invention also being fastened to the waistband of a pair of pants (25) with the bottom connecting device (11) on the inside (23) toward the skin. Here the personal item is connected directly to the bottom connecting device.

In an alternative embodiment, shown in FIGS. 6*a*-8*b*, the clamping elements are formed by two preferably identically shaped jaw elements (30), constructed from a reasonably stiff and resilient material, are bound together on the inside by a spring hinge (31) wrapped around a pin element (32) that passes through holed tabs (33) originating from both of the respective identically shaped jaws elements (30). The spring hinge (31) is located at or slightly above or below the midsection of the respective identical jaw elements and forces the bottom sections (34) of the respective jaw elements resiliently one against the other. The spring is comprised of a coiled resilient material such as metal or plastic with two longer pieces (36) that extend from each end and act to either push the jaw elements closed from the inside the top or to hold the bottom sections closed from the outside or a combination of the two. The bottom connecting device (11) herein can originate from inside or outside either half or both sides of the respective identical jaw elements and can be permanently or temporarily fastened to itself and one side of the jaw element by bolting, screwing, gluing, or any other such attachment method enclosing an intermediate connecting device. To open the clamp pressure is applied by squeezing the open ends (35) of the jaw elements one toward the other forcing the opposite ends open thereby allowing it to attach to a substrate and, when pressure is released, to fasten to the waistband of pants or other such item. This alternative clamping jaw version can likewise support decorative top or bottom lids that are either permanent/removable and/or interchangeable. This embodiment operates in a manner similar to a butterfly clip or clothespin.

Figure 9A:
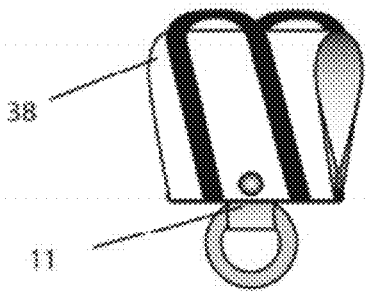
FIG. 9*a* shows a front view of a 2$^{nd}$ alternative embodiment of the clamp herein.
Figure 9B:
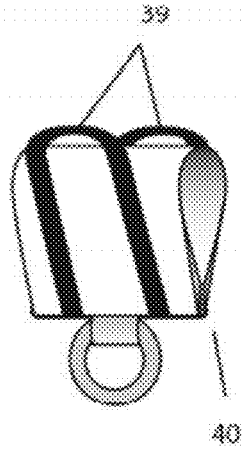
FIG. 9*b* shows a rearward view of the clamp shown in FIG. 9*a*.
Figure 9C:
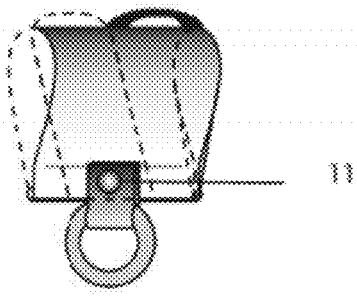
FIG. 9*c* is a partial view through of the clamp of FIG. 9*a* showing the attaching element attached to one of the jaw elements.
Figure 10A:
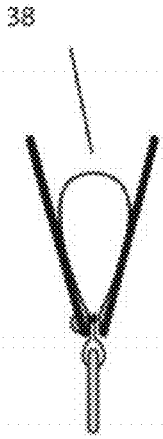
FIG. 10*a* is a side view of the clamp in FIG. 9*a*.
Figure 10B:
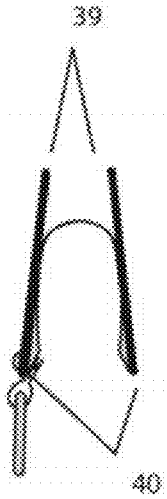
FIG. 10*b* is a side view of the FIG. 9*a* clamp in the open position.

In another embodiment of the clamp herein, shown in FIGS. 9*a*-10*b*: two identical clamping jaw halves are formed together as a single contiguous piece (FIG. 9). The two jaw halves are linked one to the other by a continuous curved or squared end shaped spring element (38) opposite the ends where the two free ends of the respective jaw halves meet and form the clamp (40). In the resting position the ends meet tightly owing to the action of the contiguous spring (38). The bottom connecting device (11) can be attached from the inside or outside of either side of the respective jaw elements by bolt, screw, glue or other such attachment method. A pair of lever elements (39), that are hingedly attached to the clamping ends, fold over toward the curved or squared spring end and, when squeezed together, cause the clamped ends to open (FIG. 10*b*). This allows the clamp to attach to the waistband or other substrate and is secured by the force of the clamp once pressure is relieved from the levers. This embodiment can likewise host decorative top or bottom lids that are either permanent/removable and/or interchangeable. This embodiment operates in manner similar to a paper clamp.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

What is claimed is:

1. An apparel clamp, comprising:

a first clamping jaw and an underlying opposed second clamping jaw, related one to the other by biased hinge means for biasing said first and second jaws between an open position and a closed position in accord with user manipulation of said clamp, said clamping jaws adapted to clamp to an edge of a substrate when in said closed position;

a resilient connecting element having a first free end and a second attached end associated with said first clamping jaw, and mounted via said second attached end on a side of said jaw opposed to said second clamping jaw, said first free end being adapted for accepting an attaching member of a disassociated item, said attaching member placed over and slid down said free end, thereby maintaining said item in association with said clamp; and, an overlaying lid element also hinged to said first clamping jaw, said lid element being likewise movable between open and closed positions, said lid element also including a wedging element which acts so as to wedge each of said first and second jaws one against the other when said lid element is urged into said closed position and to overlie and capture said resilient connecting element first free end against said second attached end, thereby preventing removal of said disassociated item from said resilient connecting element.

2. The device of claim 1, further comprising:

respective securing devices mounted to opposed clamping surfaces of said first and second clamping jaws to enhance attachment of said clamp to said substrate.

3. The device of claim 1, further comprising:

additional resilient connecting elements mounted to one of said first or second clamping jaws.

4. The device of claim 1, further comprising:

a decorative element affixed to an outer exposed surface of said lid element.

* * * * *